US005817923A

United States Patent [19]

Ohsaki et al.

[11] Patent Number: 5,817,923

[45] Date of Patent: Oct. 6, 1998

[54] APPARATUS FOR DETECTING THE FUEL PROPERTY FOR AN INTERNAL COMBUSTION ENGINE AND METHOD THEREOF

[75] Inventors: Masanobu Ohsaki; Seiichi Ohtani; Mitsuru Miyata, all of Atsugi, Japan

[73] Assignee: Unisia Jecs Corporation, Kanagawa-ken, Japan

[21] Appl. No.: 788,663

[22] Filed: Jan. 24, 1997

[30] Foreign Application Priority Data

Jan. 25, 1996 [JP] Japan ..... 8-010617

[51] Int. Cl.[6] ..... F02D 19/06

[52] U.S. Cl. ..... 73/35.02; 73/23.31; 73/116; 123/1 A

[58] Field of Search ..... 73/23.31, 35.02, 73/116; 123/1 A, 435

[56] References Cited

U.S. PATENT DOCUMENTS

| | | | |
|---|---|---|---|
| 5,381,767 | 1/1995 | Kikuchi | 123/339 |
| 5,499,607 | 3/1996 | Tomisawa | 73/116 |
| 5,513,609 | 5/1996 | Hirose et al. | 123/339.14 |
| 5,537,978 | 7/1996 | Watanabe et al. | 73/35.02 |
| 5,542,394 | 8/1996 | Tomisawa | 123/491 |
| 5,582,157 | 12/1996 | Uchikawa | 73/116 |
| 5,586,537 | 12/1996 | Tomisawa et al. | 73/35.02 |
| 5,617,831 | 4/1997 | Shirakawa | 123/502 |

FOREIGN PATENT DOCUMENTS 4-252835 9/1992 Japan .

*Primary Examiner*—Richard Chilcot
*Assistant Examiner*—Eric S McCall
*Attorney, Agent, or Firm*—McDermott, Will & Emery

[57] ABSTRACT

A period of from when the starter switch is turned on or from the start of the fuel injection until when the engine rotation speed has reached a predetermined rotation speed, is detected as a parameter representing the starting performance. After the engine rotation speed has reached a predetermined rotation speed, furthermore, the parameter representing a change in the rotation and the parameter representing rising gradient of the rotation-speed are detected. Then, the parameter representing the starting performance, the parameter representing a change in the rotation and the parameter representing a rising gradient of the rotation speed are weighted to detect the fuel property.

18 Claims, 7 Drawing Sheets

APPARATUS FOR DETECTING THE FUEL PROPERTY FOR AN INTERNAL COMBUSTION ENGINE AND METHOD THEREOF

FIELD OF THE INVENTION

The present invention relates to an apparatus for detecting the fuel property for an internal combustion engine and to a method thereof. More specifically, the invention relates to an apparatus for detecting the property of a fuel used and, particularly, for detecting a difference in the vaporization factor depending upon whether the fuel is heavy or light, and to a method thereof.

RELATED ART OF THE INVENTION

There has heretofore been proposed an apparatus for detecting a difference in the vaporization factor of a fuel relying upon the operation condition of an engine as disclosed in Japanese Unexamined Patent Publication No. 4-252835.

According to this prior art, the fuel property is detected depending upon a time required by an engine that is started to reach a second rotation speed from a first rotation speed which is slower than the second rotation speed, or is detected depending upon an integrated value of a difference between a running average value and an instantaneous value of a rotation speed at the time of start.

According to the apparatus disclosed in the above Japanese Unexamined Patent Publication No. 4-252835 which detects the fuel property relying solely upon a rising gradient of the rotation speed or upon a change in the rotation, however, a large fluctuation is involved in the rising gradient or in a change in the rotation due to the timing for turning the starter switch off or the conditions for halting the engine, making it difficult to detect the fuel property to a high accuracy.

Besides, the rising gradient of rotation and the change in the rotation are affected relatively little by the fuel property. Therefore, even if it is presumed that the cause of fluctuation is not involved, it is difficult to highly precisely detect the fuel property depending solely upon a rising gradient of the rotation speed or upon a change in the rotation.

SUMMARY OF THE INVENTION

The present invention was accomplished in view of the above-mentioned problems, and its object is to provide an apparatus for detecting the property of a fuel that is used to a high accuracy relying upon a rotation speed at the time of start and a method thereof.

Another object of the present invention is to prevent a drop in the precision for detecting the fuel property by the influence of the engine temperature at the time of start.

In order to accomplish the above-mentioned objects according to the apparatus for detecting the fuel property for an internal combustion engine and a method thereof of the present invention, a parameter representing the starting performance of the engine, a parameter representing a change in the rotation when the engine is started and a parameter representing a rising gradient of the rotation speed when the engine is started are detected, respectively, and the property of the fuel used is detected relying upon the parameter representing the starting performance, parameter representing a change in the rotation and parameter representing a rising gradient.

According to the constitution of the present invention, the fuel property is not detected depending upon any one of the parameter representing the starting performance of the engine, parameter representing a change in the rotation when the engine is started or parameter representing a rising gradient of the rotation speed when the engine is started. Instead, the fuel property is detected by totally judging the above-mentioned three parameters, thereby enabling the fuel property detection to a high accuracy.

It is here preferable that the parameter representing the starting performance, parameter representing a change in the rotation and parameter representing a rising gradient are all weighted to detect the fuel property.

It is preferable to weight the parameter representing the starting performance to the largest extent among the above-mentioned three parameters.

In detecting the fuel property by imparting the weighting as described above, it is preferable that the fuel property is detected by comparing a value obtained by the addition or multiplication of the parameter representing the starting performance, parameter representing a change in the rotation and parameter representing a rising gradient that are all weighted, with a reference value that is set depending upon the engine temperature.

The engine temperature can be represented by the cooling water temperature.

In detecting the fuel property by imparting the weighting, furthermore, it is also preferable to weight the parameter representing the starting performance, the parameter representing a change in the rotation, the parameter representing a rising gradient and the reference value that is set depending upon the engine temperature and compare these with each other, thereby to detect the fuel property based upon the results of comparison of these parameters.

It is further preferable to detect the parameter representing the starting performance, parameter representing a change in the rotation and parameter representing a rising gradient independently of each other based upon a period with a number of cycles of the engine as a unit.

As the parameter representing the starting performance, a period can be detected from when the starter switch is turned on or from the start of the fuel injection until when the engine rotation speed has reached a predetermined rotation speed.

The parameter representing a change in the rotation and the parameter representing a rising gradient of the rotation speed may be detected after the engine rotation speed has reached a predetermined rotation speed from when the starter switch is turned on or from the start of the fuel injection.

It is further preferable to operate the amount of change in the engine rotation speed for every predetermined unit period of time from when the predetermined rotation speed is exceeded by the engine rotation speed after the starter switch is turned on or after the start of the fuel injection, in order to detect, as a parameter representing a change in the rotation, a period until an integrated value of the amount of change reaches a predetermined value.

Moreover, it is preferable to detect, as the parameter representing a rising gradient, a period in which an integrated value of the amount of change in the engine rotation speed for every predetermined unit period of time changes from a first predetermined value to a second predetermined value until the engine rotation speed has exceeded a predetermined rotation speed after the starter switch is turned on or after the start of the fuel injection.

Other objects and features of the invention will become obvious from the following description of the embodiments in conjunction with the accompanying drawings.

PREFERRED EMBODIMENTS

Embodiments of the invention will now be described with reference to the accompanying drawings.

Figure 1:
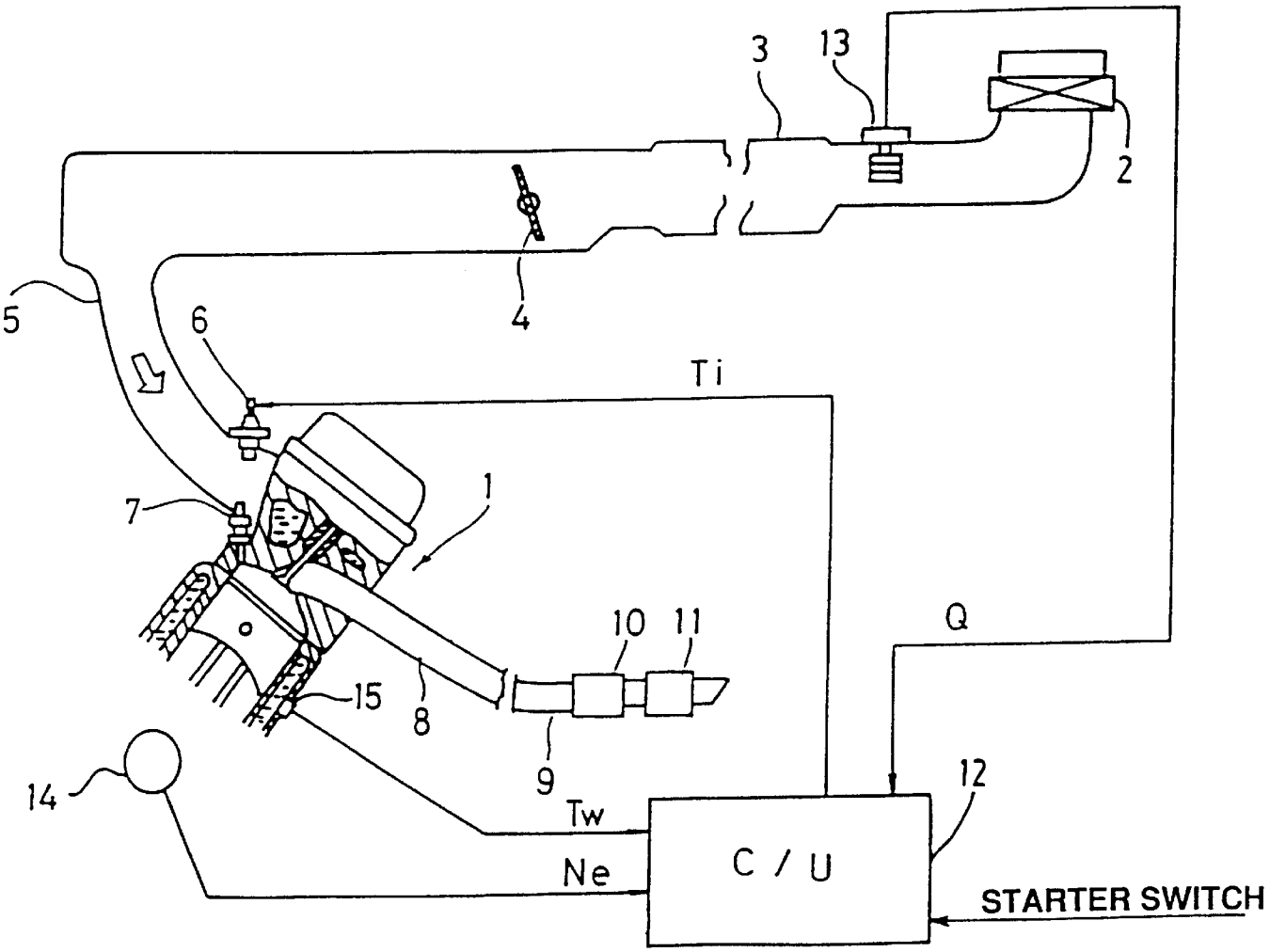
FIG. 1 is a diagram illustrating a system constitution according to an embodiment of the present invention.

Referring to FIG. 1 illustrating a system constitution of the embodiment, an internal combustion engine 1 intakes an air from an air cleaner 2 through an intake duct 3, a throttle valve 4 and an intake manifold 5. Each branch of the intake manifold 5 is provided with a fuel injection valve 6 for each of the cylinders.

The fuel injection valve 6 is of the electromagnetic type which opens when a solenoid thereof is supplied with an electric current and closes when the supply of electric current thereto is interrupted. The fuel injection valve 6 opens upon receiving a drive pulse signal from a control unit 12 that will be described later and intermittently injects a fuel into the engine 1, the fuel being supplied from a fuel pump that is not shown and adjusted by a pressure regulator to a predetermined pressure.

Each combustion chamber of the engine 1 is provided with an ignition plug 7 which ignites and burns a mixture gas introduced into the cylinder. The engine 1 discharges an exhaust gas through an exhaust manifold 8, an exhaust duct 9, a catalytic converter 10 and a muffler 11.

A control unit 12 which electronically controls the supply of fuel to the engine 1 is equipped with a microcomputer which includes CPU, ROM, RAM, A/D converter, input/output interface, etc., receives input signals from various sensors, executes the operation as will be described later and controls the operation of the fuel injection valve 6.

One of the various sensors will be an air flow meter 13 provided in the intake duct 3, which outputs, to the control unit 12, a signal corresponding to the intake air flow amount Q of the engine 1.

Provision is further made of a crank angle sensor 14 which outputs a reference angle signal REF for every reference piston position (e.g., for every TDC) and a unit angle signal POS for every 1° or 2°. The control unit 12 which receives these signals measures the period of the reference angle signal REF or the number of the unit angle signals POS generated within a predetermined period of time, in order to calculate an engine rotation speed Ne.

There is further provided a water temperature sensor 15 for detecting the cooling water temperature Tw in the water jacket of the engine 1.

The control unit 12 further receives a signal from a starter switch.

The CPU in the microcomputer contained in the control unit 12 executes the operation according to a program in the ROM, operates a fuel injection amount (injection pulse width) Ti into the engine 1, and outputs, to the fuel injection valve 6, a drive pulse signal of a pulse width corresponding to the above fuel injection amount Ti at a predetermined injection timing.

The fuel injection amount Ti is calculated as,

Fuel injection amount Ti=basic injection amount Tp×various correction coefficients Co+voltage correction components Ts.

The basic fuel injection amount Tp is a basic value determined depending upon the intake air flow amount Q and the engine rotation speed Ne, and the voltage correction component Ts is the one which compensates for an invalid injection amount caused by a drop in the battery voltage.

Various correction coefficients Co are calculated in a manner of for example, Co={1+air-to-fuel ratio correction coefficient $K_{MR}$+increment correction coefficient $K_{TW}$ depending upon the water temperature+increment correction coefficient $K_{AS}$ at the start and after the start+increment correction coefficient $K_{ACC}$ during the acceleration+decrement correction coefficient $K_{DC}$ during the deceleration+. . . }.

The air-to-fuel ratio correction coefficient $K_{MR}$ is the one for so correcting the basic injection amount Tp that an optimum air-to-fuel ratio is obtained for the engine rotation speed Ne and for the engine load. The increment correction coefficient $K_{TW}$ depending upon the water temperature is to increasingly correct the fuel injection amount when the cooling water temperature Tw is low.

The increment correction coefficient $K_{AS}$ at the start and after the start increasingly corrects the injection amount when the cooling water temperature Tw is low at the time of start and immediately after the start, gradually decreases the increment correction amount at a predetermined rate after the start so that the increment correction amount finally becomes zero, in order to maintain starting performance and operation performance immediately after the start.

The increment correction coefficient $K_{ACC}$ during the acceleration and the decrement correction coefficient $K_{DC}$ during the deceleration are to increasingly or decreasingly correct the fuel injection amount in order to avoid a change in the air-to-fuel ratio at the time of transient condition of the engine.

The request for correcting the fuel injection amount depending upon various correction coefficients Co changes depending upon the property of the fuel that is used and, particularly, depending upon the vaporization factor which varies depending upon whether the fuel is heavy or light. When a heavy fuel having a low vaporization factor is used, the request for increment correction depending upon the correction coefficient $K_{AS}$, and $K_{TW}$ and $K_{ACC}$ becomes stronger than that of when a light fuel having a high vaporization factor is used.

Therefore, the control unit 12 detects whether the fuel is heavy or light in a manner as described below, and corrects the correction coefficients $K_{AS}$, $K_{TW}$ and $K_{ACC}$ so as to be adapted to the fuel that is really used depending upon the result of detecting the fuel property. The result of detecting heavy or light fuel may be used for other control operations such as controlling the ignition timing, etc.

Figure 2:
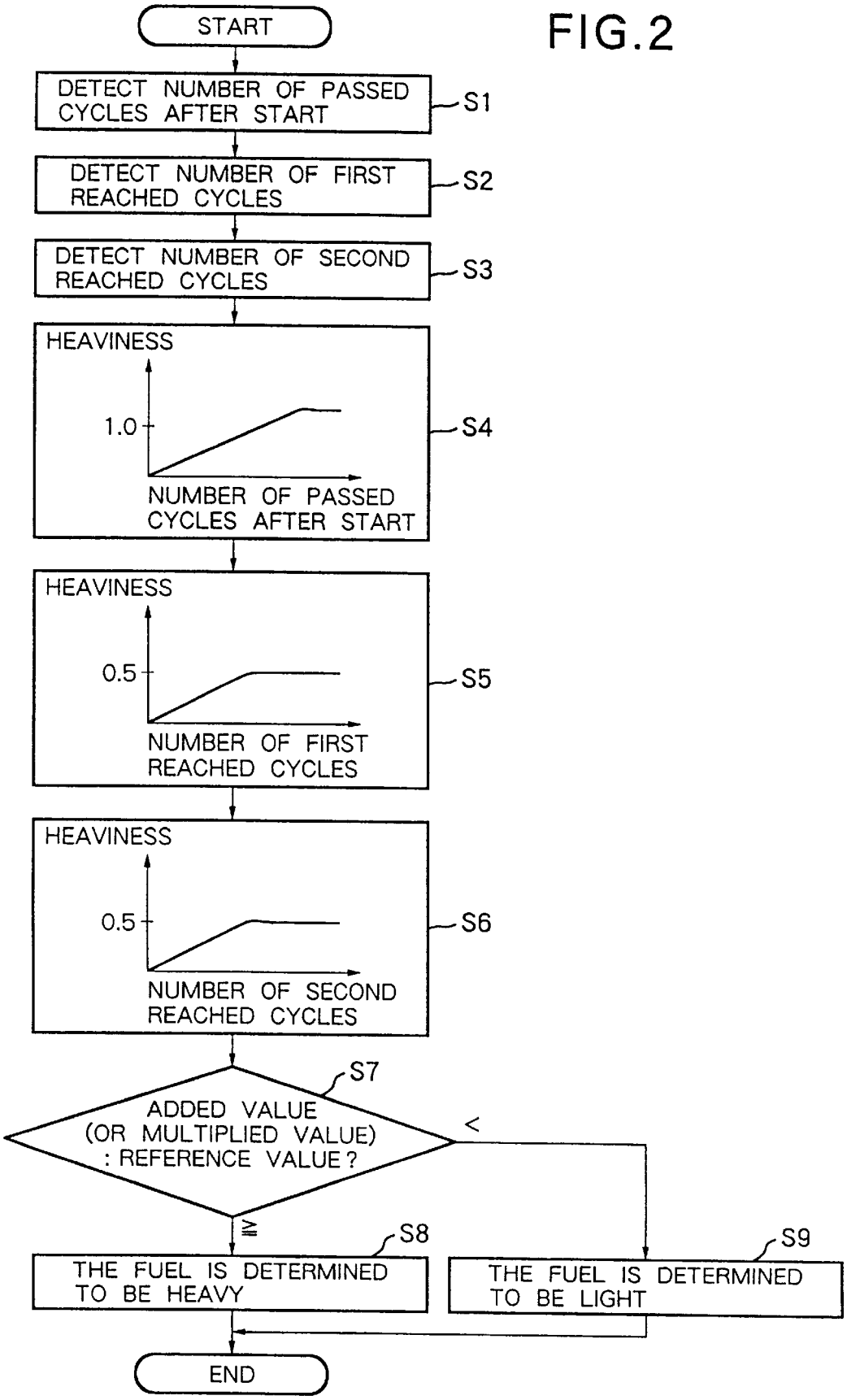
FIG. 2 is a flow chart illustrating a routine of detection of the fuel property according to the embodiment.

A flow chart of FIG. 2 illustrates the detection control of the fuel property by the control unit 12.

Functions of means for detecting the starting performance, means for detecting a change in the rotation, means for detecting a rising gradient and means for detecting the fuel property of the present invention are possessed by the control unit 12 in a software manner as shown in the flow chart of FIG. 2.

In the flow chart of FIG. 2, first, step 1 (denoted by S1 in the drawing, the same holds hereinafter) to step 3 detect a number of passed cycles after the start as a parameter for representing a starting performance, a number of first reached cycles as a parameter for representing a change in the rotation at the time of start, and a number of second reached cycles as a parameter for representing a rising gradient of rotation at the time of start.

Figure 3:
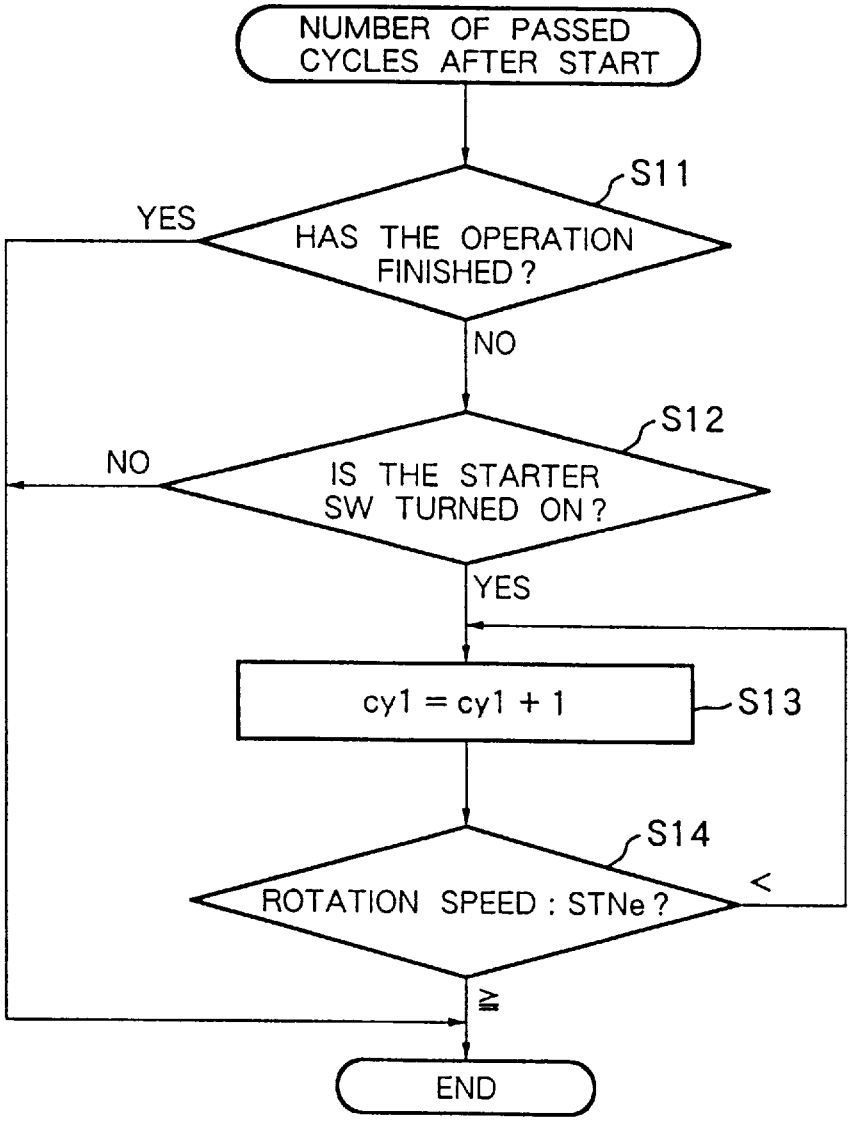
FIG. 3 is a flow chart illustrating a routine of detection of a number of passed cycles after the start for representing the starting performance according to the embodiment.

A flow chart of FIG. 3 illustrates in detail the detection control of the number of passed cycles after the start in step 1.

The flow chart of FIG. 3 is executed for every predetermined cycle (e.g., for every one-half turn) of the engine. At step 11, it is determined whether the operation of the number of passed cycles after the start has been finished or not. When the operation has not been finished, the routine proceeds to step 12.

At step 12, it is determined whether the starter switch is turned on or not. When the starter switch is turned on and the starter motor is actuated, the routine proceeds to step 13.

The start of the fuel injection into the engine may be detected instead of detecting whether the starter switch is turned on. That is, after the starter switch is turned on, the engine begins to rotate by cranking and, then the fuel is injected. A period from when the starter switch is turned on until the start of the fuel injection is not affected by the fuel property. Depending upon the cases, therefore, it is better to detect the start of the fuel injection from the standpoint of precision.

At step 13, the number of passed cycles cyl (initial value=$\phi$) after the start is increased by 1. At next step 14, it is determined whether the engine rotation speed Ne is higher than a predetermined rotation speed STNe or not.

It is preferred that the predetermined rotation speed STNe is a rotation speed of when the engine starts rotating by itself, which may be, for example, about 300 rpm.

When it is determined at step 14 that the engine rotation speed Ne is smaller than the predetermined rotation speed STNe, the routine returns back to step 13 where the number of passed cycles cyl after the start is further increased by 1. The operation for increasing the number of passed cycles cyl after the start by 1 is repeated at step 13 until the engine rotation speed Ne becomes equal to or larger than the predetermined rotation speed STNe.

Thus, the number of passed cycles cyl after the start is found as the number of cycles from when the starter switch is turned on (or from the start of the fuel injection until the engine rotation speed Ne has reached the predetermined rotation speed STNe.

It is here possible to detect the period from when the starter switch is turned on (or from the start of the fuel injection until the engine rotation speed Ne has reached the predetermined rotation speed STNe not as the number of cycles (integrated rotation number) but as a time. The time, however, undergoes a change being affected by the battery voltage. It is therefore preferable as described above to find the period as the number of cycles (integrated rotation number). Because of the same reason, the period is defined by the number of cycles even in a number of first reached cycles and in a number of second reached cycles that will be described later.

When the fuel is heavy and has a low vaporization factor, in general, the starting performance is deteriorated and the starting period is lengthened (see FIG. 7) under the condition where the battery voltage remains constant. As the fuel becomes heavier, therefore, the number of passed cycles after the start increases; i.e., the number of passed cycles after the start serves as a parameter for representing the starting performance.

Figure 4:
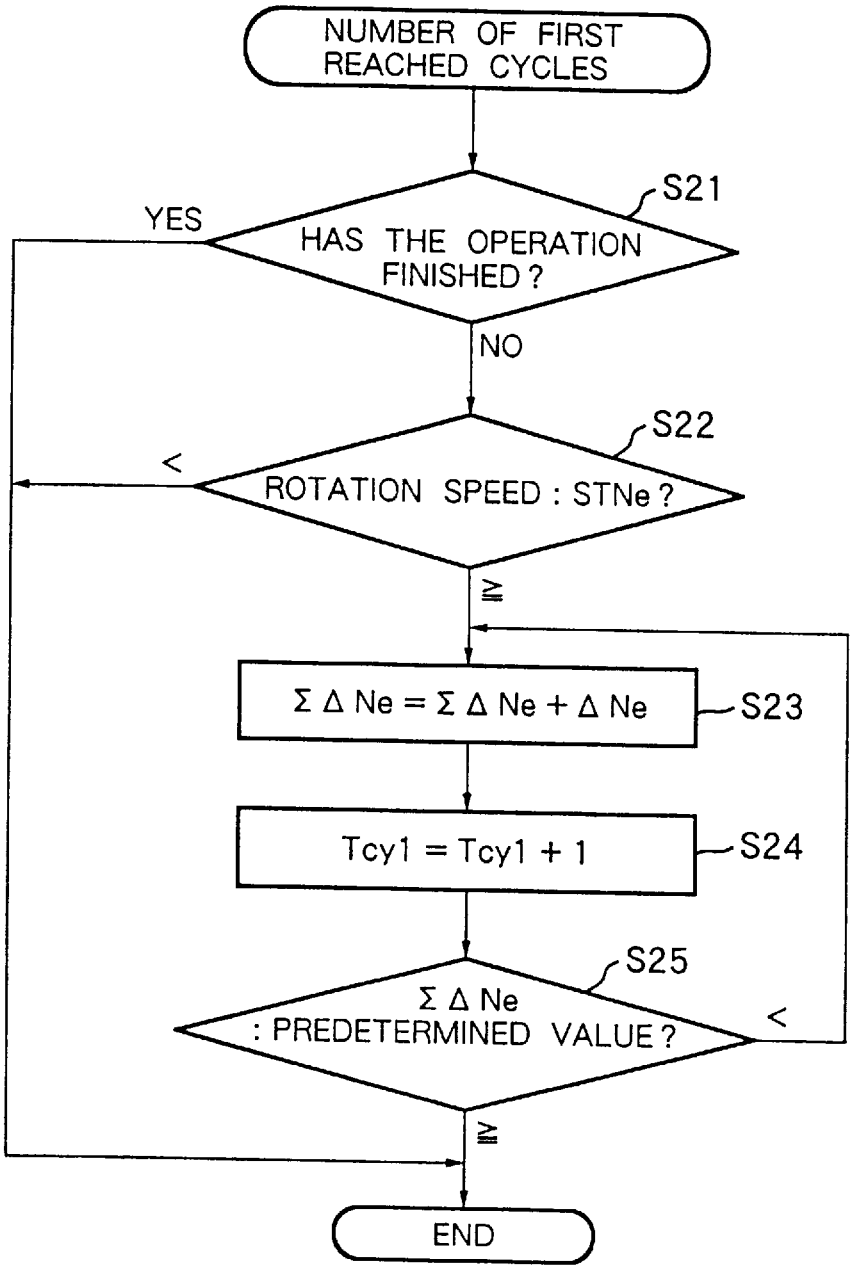
FIG. 4 is a flow chart illustrating a routine of detection of a number of first reached cycles for representing a change in the rotation according to the embodiment.

A flow chart of FIG. 4 illustrates in detail the detection control of the number of first reached cycles. Like the flow chart of FIG. 3, the flow chart of FIG. 4 is executed for every predetermined cycle (e.g., for every one-half turn) of the engine.

In the flow chart of FIG. 4, first, it is determined at step 21 whether the operation of the number of first reached cycles has been finished or not. The routine proceeds to step 22 only when the operation has not been finished.

At step 22, it is discriminated whether the engine rotation speed Ne is higher than the predetermined rotation speed STNe (e.g., 300 rpm) or not. It is desired that the predetermined rotation speed STNe is set to be the same as the predetermined rotation speed STNe at step 14 in the flow chart of FIG. 3.

When the engine 1 starts rotating by itself and runs at a speed equal to or faster than the predetermined rotation speed STNe after the starter switch has been turned on (after the start of the fuel injection), the routine proceeds to step 23.

The step 23 finds the change amount $\Delta Ne$ ($\Delta Ne$=latest Ne—previous Ne (one-half turn before)) in the rotation speed Ne during the period (predetermined unit period) for executing the routine, adds the change amount to the integrated value $\Sigma\Delta Ne$ of up to the previous time, and executes a processing to use the added result as a new integrated value $\Sigma\Delta Ne$.

The initial value of the integrated value $\Sigma\Delta Ne$ is $\phi$, and the result of integration of the change amount $\Delta Ne$ in the rotation speed for every one-half turn after the rotation speed Ne has become equal to or higher than the predetermined rotation speed STNe in compliance with the processing of step 23, is the integrated value $\Sigma\Delta Ne$.

At step 24, the number of first reached cycles Tcyl is increased by 1 and at step 25, it is determined whether the integrated value $\Sigma\Delta Ne$ has become equal to or larger than a predetermined value (e.g., 500 rpm).

The processing for updating the integrated value $\Sigma\Delta Ne$ and for increasing the number of first reached cycles Tcyl by 1 at step 23, is repeated until the integrated value $\Sigma\Delta Ne$ becomes equal to or larger than the predetermined value. The routine ends at a moment when the integrated value $\Sigma\Delta Ne$ has exceeded the predetermined value. Thus, the number of first reached cycles Tcyl is found as the number of cycles until the integrated value $\Sigma\Delta Ne$ has reached the predetermined value after the rotation speed Ne has become equal to or larger than the predetermined rotation speed STNe.

Figure 7:
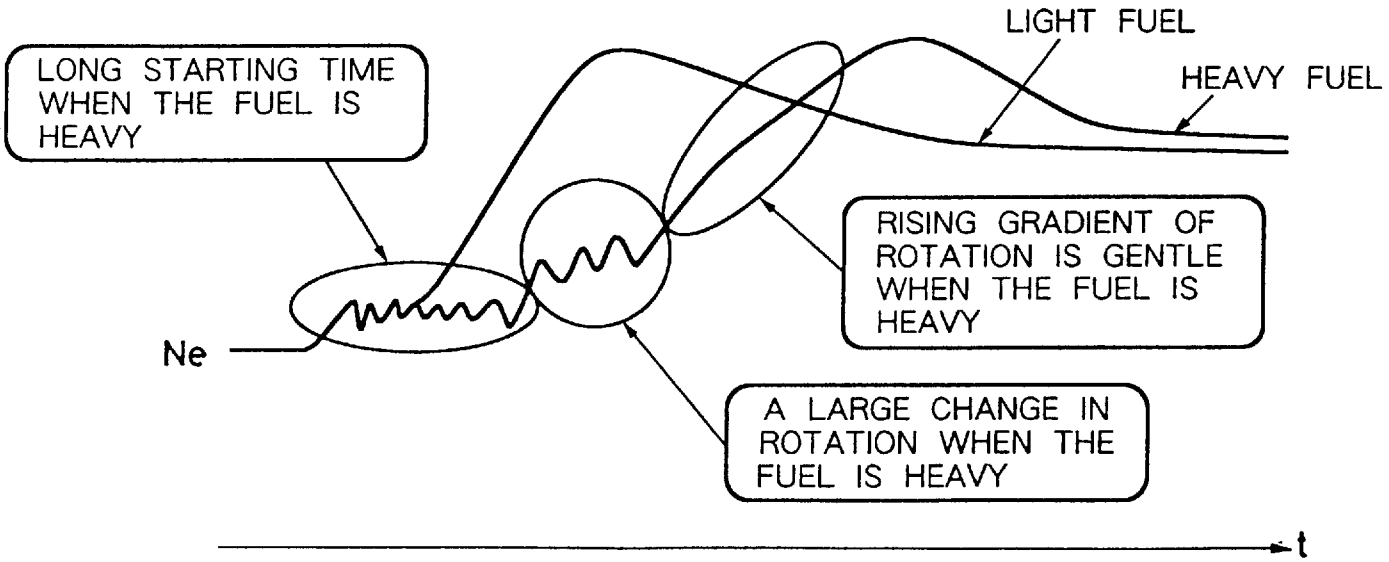
FIG. 7 is a time chart illustrating a change characteristic in the rotation at the time of starting depending upon whether the fuel is heavy or light.

In general, the heavier the fuel used, the larger the change amount in the rotation at the time of start (see FIG. 7). When the rotation fluctuates, the change amount $\Delta Ne$ is calculated as a negative value due to a drop in the rotation speed and, hence, the integrated value $\Sigma\Delta Ne$ increases or decreases. The number of cycles by which the integrated value $\Sigma\Delta Ne$ reaches the predetermined value increases with an increase in the change of the rotation. As the fuel becomes heavier, therefore, the number of first reached cycles Tcyl increases, and hence serves as a parameter for representing a change in the rotation.

The number of first reached cycles Tcyl is affected by a rising gradient of rotation. Immediately after the rotation speed Ne becomes equal to or larger than the predetermined rotation speed STNe, however, the number of first reached cycles Tcyl is more strongly affected by the change in the rotation than by a difference in the gradient, thus making it possible to detect the change in the rotation caused by the fuel property.

As the parameter representing a change in the rotation, there may be found a parameter for representing a change in the rotation based upon an integrated value of a difference between a running average and an instantaneous value of the rotation speed, period in which the rotation speed is decreasing, analytical result of a frequency of a change in the rotation speed, and a maximum value and a minimum value of the rotation speed, in addition to the number of first reached cycles Tcyl.

Figure 5:
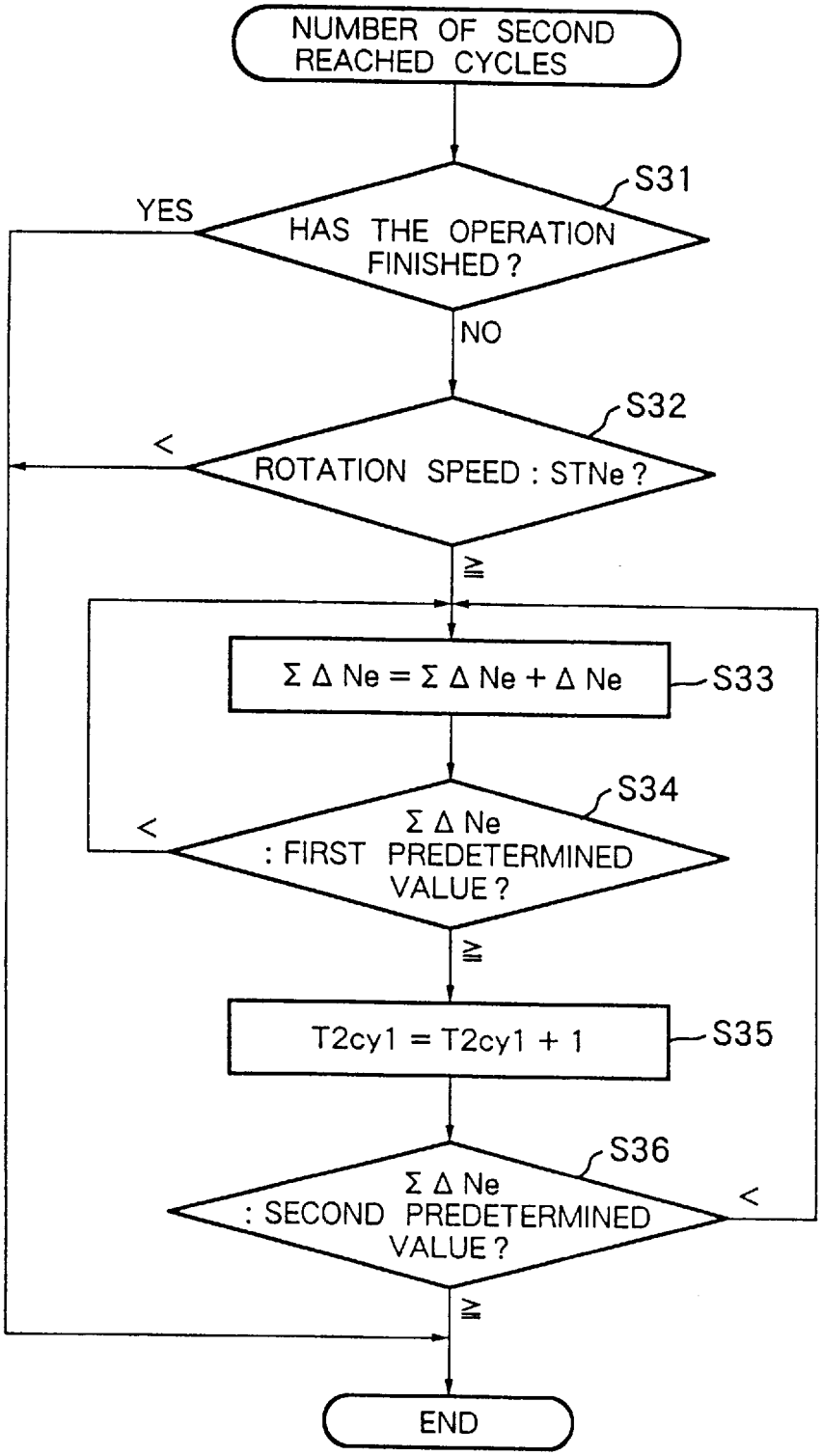
FIG. 5 is a flow chart illustrating a routine of detection of a number of second reached cycles for representing a rising gradient according to the embodiment.

A flow chart of FIG. 5 illustrates in detail the detection control of a number of second reached cycles in step 3. Like the flow chart of FIG. 4, the flow chart of FIG. 5 is executed for every predetermined cycle (e.g., for every one-half turn) of the engine.

In the flow chart of FIG. 5, first, it is determined at step 31 whether the operation of the number of second reached cycles has been finished or not. When it has not been finished it is determined at step 32 whether, after the starter switch is turned on (after the start of the fuel injection), the rotation speed Ne has become equal to or larger than the predetermined rotation speed STNe (e.g., 300 rpm) or not.

When the rotation speed Ne becomes equal to or larger than the predetermined rotation speed STNe, step 33 commences the operation of the integrated value ΣΔNe and step 34 determines whether the integrated value ΣΔNe has become equal to or larger than a first predetermined value (e.g., 500 rpm) or not.

The routine returns back to step 33 until the integrated value ΣΔNe reaches the first predetermined value, and the routine proceeds to step 35 at a moment when the integrated value ΣΔNe becomes equal to or larger than the first predetermined value.

At step 35, the number of second reached cycles T2cyl is increased by 1 and at next step 36, it is determined whether the integrated value ΣΔNe has become larger than a second predetermined value (>first predetermined value) or not.

The routine returns back to step 33 to repeat the operation for updating the integrated value ΣΔNe and the operation for increasing the number of second reached cycles T2cyl by 1 until the integrated value ΣΔNe becomes equal to or larger than the second predetermined value. The routine ends at a moment when the integrated value ΣΔNe becomes equal to or larger than the second predetermined value. Thus, the number of second reached cycles T2cyl is found as the number of cycles required for the integrated value ΣΔNe to reach the second predetermined value from the first predetermined value.

When the fuel used is heavy, in general, the rotation speed rises slowly (see FIG. 7), and an increased number of cycles are required for the integrated value ΣΔNe to change from the first predetermined value to the second predetermined value. Accordingly, the number of second reached cycles T2cyl increases as the fuel becomes heavier, and hence serves as a parameter representing a rising gradient of the rotation speed.

The number of second reached cycles is affected even by a change in the rotation. The rotation, however, changes mainly in the initial stage in which the engine starts revolving by itself. By setting the first predetermined value to be not lower than, for example, 500 rpm, the rising gradient can be precisely detected without affected by a change in the rotation.

As a parameter representing a rising gradient of the rotation speed, it is also allowable to find the number of times (number of cycles) the change amount ΔNe of the rotation speed Ne per one-half turn is calculated as a positive value which is equal to or larger than the predetermined value within a predetermined number of cycles after the rotation speed Ne has become equal to or larger than the predetermined rotation speed STNe (300 rpm) after the starter switch is turned on (after the start of the fuel injection), or to find a maximum value and an average value of the change ΔNe within the predetermined number of cycles, in addition to finding the above-mentioned number of second reached cycles T2cyl.

Upon detecting the parameters representing the starting performance, change in the rotation and rising gradient of rotation as described above, step 4 in the flow chart of FIG. 2 converts the number of passed cycles cyl after the start which represents the starting performance into a parameter representing the heaviness of the fuel based upon a table that has been set in advance.

Here, the parameter representing the heaviness of the fuel corresponding to the number of cycles is set to a large value with an increase in the number of passed cycles cyl after the start. That is, the larger the value of the parameter representing the heaviness, the heavier the fuel.

Similarly at step 5, the number of first reached cycles Tcyl representing a change in the rotation is converted into a parameter representing the heaviness based upon a table that has been set in advance.

At step 6, furthermore, the number of second reached cycles T2syl representing a rising gradient of the rotation is converted into a parameter representing the heaviness based on a table that has been set in advance.

At steps 5 and 6 like at step 4, the parameter representing the heaviness corresponding to the number of cycles is set to a large value with an increase in the numbers of first and second reached cycles, and the latter the value of the parameter representing the heaviness, the heavier the fuel is.

The starting performance, change in the rotation and rising gradient of rotation are affected by the heaviness of the fuel used in the order of starting performance > change in the rotation ≧ rising gradient of rotation. Therefore, in converting the parameters representing the starting performance, change in the rotation and rising gradient of rotation into the parameters representing heaviness, respectively, the starting performance is most greatly weighted, and the change in the rotation and the rising gradient of rotation are weighted less than the starting performance.

Concretely speaking, a maximum value of the parameter representing the heaviness determined depending upon the change of rotation and the numbers of first and second reached cycles representing the rising gradient of rotation, is set to a value (e.g., 0.5) which is smaller than a maximum value (e.g., 1.5) of the parameter representing the heaviness that is set depending upon the number of passed cycles after the start which represents the starting performance.

This makes it possible to detect the heaviness of the fuel by taking the change in the rotation and the rising gradient of rotation into consideration while placing importance to the starting performance that is most affected by the heaviness of the fuel.

At step 7, the added value (or multiplied value) of the parameters representing the heaviness obtained by converting the parameters representing the starting performance, change in the rotation and rising gradient of rotation, is compared with a reference value that is set depending upon the cooling water temperature which represents the engine temperature.

The reference value with which the added value (or multiplied value) of the parameters representing the heaviness is compared, is determined depending upon the cooling water temperature which represents the engine temperature because of the reason that the starting performance, change in the rotation and rising gradient of rotation change by the influence of the engine temperature, and this makes it possible to avoid a drop in the precision for detecting the fuel property (heaviness) due to a change in the engine temperature.

When it is determined at step 7 that the added value (or multiplied value) of the parameters representing the heaviness is equal to or larger than the reference value, the routine proceeds to step 8 where a signal is output to indicate that the fuel that is used is heavy. When it is determined that the added value (or multiplied value) of the parameters representing the heaviness is smaller than the reference value, the routine proceeds to step 9 where a signal is output to indicate that the fuel used is light.

Based upon the above detected result, the control unit 12 corrects the correction coefficient $K_{AS}$, $K_{TW}$, and $K_{ACC}$.

In the foregoing description, the fuel was classified into two kinds, i.e., heavy and light depending upon the comparison of the added value (or multiplied value) of the parameters representing the heaviness with the reference value. The fuel, however, may be classified into three or more levels based upon the comparison with a plurality of reference values, or the added value (or multiplied value) may be converted into a correction coefficient, and the aforementioned correction coefficients $K_{TW}$, etc. may be corrected relying upon this correction coefficient.

Or, the heaviness of the fuel may be determined depending upon each of the parameters representing the starting performance, change in the rotation and rising gradient of rotation, and the fuel may finally be determined to be heavy, for example, only after the heaviness is detected by the three parameters.

Figure 6:
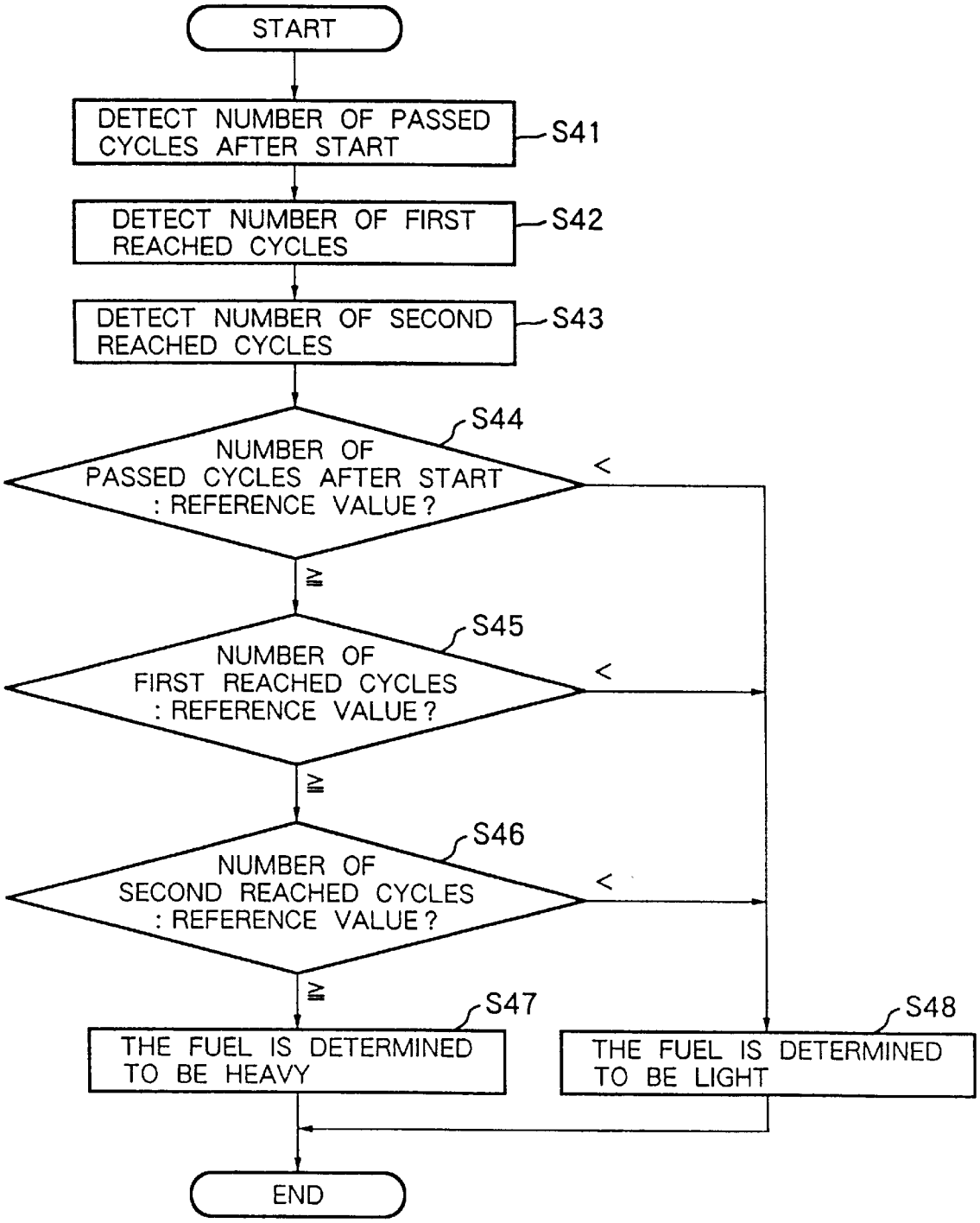
FIG. 6 is a flow chart illustrating another embodiment for detecting the fuel property according to another embodiment.

Concretely speaking as shown in a flow chart of FIG. 6, the parameters (number of passed cycles after the start, number of first reached cycles, number of second reached cycles) representing the starting performance, change in the rotation and rising gradient of rotation, are found respectively (step 41 to step 43). Then, these parameters (or value obtained by converting these parameters into heaviness) are compared with a reference value set depending upon the cooling water temperature. Only when the fuel is determined to be heavy relying upon these three parameters, the routine proceeds to step 47 to output a signal to finally indicate that the fuel used is heavy. When any one of these three parameters indicate that the fuel is light, the routine proceeds to step 48 to output a signal to finally indicate that the fuel that is used is light.

In this case, too, the reference value to be compared with the parameters is weighted by being set for each of the parameters, or the parameters are weighted depending upon the conversion characteristics when the number of passed cycles after the start, the number of first reached cycles and the number of second reached cycles are converted into parameters representing heaviness and are compared with the reference value.

What is claimed is:

1. An apparatus for detecting a fuel property for an internal combustion engine comprising:

starting performance detecting means for detecting a parameter representing a starting performance of the engine;

change in rotation detecting means for detecting a parameter representing a change in engine rotation at the start of the engine;

rising gradient detecting means for detecting a parameter representing a rising gradient of engine rotation speed at the start of the engine; and fuel property detecting means for outputting a signal representing a property of the fuel used based upon the parameter representing the starting performance, the parameter representing the change in engine rotation, and the parameter representing the rising gradient.

2. An apparatus for detecting the fuel property for an internal combustion engine according to claim 1, wherein said fuel property detecting means detects the fuel property by weighting the parameter representing the starting performance, engine parameter representing a change in the rotation and the parameter representing a rising gradient.

3. An apparatus for detecting the fuel property for an internal combustion engine according to claim 2, wherein said fuel property detecting means detects the fuel property based upon a comparison of an added value or a multiplied value of the parameter representing the starting performance, the parameter representing a change in the rotation and engine parameter representing a rising gradient that have been weighted, with a reference value determined depending upon the engine temperature.

4. An apparatus for detecting the fuel property for an internal combustion engine according to claim 3, wherein the parameter representing the starting performance, engine parameter representing a change in the rotation, the parameter representing a rising gradient and the reference value that is set depending upon the engine temperature are weighted and compared with each other, and the fuel property is detected based on the comparisons.

5. An apparatus for detecting the fuel property for an internal combustion engine according to claim 1, wherein said starting performance detecting means, said change in engine rotation detecting means and said rising gradient detecting means, respectively, detect the parameter representing the starting performance, engine parameter representing a change in the rotation and the parameter representing a rising gradient based upon a period with a number of cycles of the engine as a unit.

6. An apparatus for detecting the fuel property for an internal combustion engine according to claim 1, wherein said starting performance detecting means detects a period of from when the starter switch is turned on or from the start of the fuel injection until when the engine rotation speed has reached a predetermined rotation speed, as a parameter representing the starting performance.

7. An apparatus for detecting the fuel property for an internal combustion engine according to claim 1, wherein said change in engine rotation detecting means and said rising gradient detecting means, respectively, detect the parameter representing a change in the rotation and engine parameter representing a rising gradient in the rotation speed after the engine rotation speed has reached a predetermined rotation speed from when the starter switch is turned on or from the start of the fuel injection.

8. An apparatus for detecting the fuel property for an internal combustion engine according to claim 7, wherein said change in engine rotation detecting means operates a change amount in the engine rotation speed for every predetermined unit period of time after the engine rotation speed has exceeded a predetermined rotation speed from when the starter switch is turned on or from the start of the fuel injection, and detects a period until an integrated value of the change amount has reached a predetermined value as a parameter representing a change in engine rotation.

9. An apparatus for detecting the fuel property for an internal combustion engine according to claim 7, wherein said rising gradient detecting means detects, as a parameter representing a rising gradient, a period until an integrated value of a change amount of the engine rotation speed for every predetermined unit period of time reaches a second predetermined value from a first predetermined value after the engine rotation speed has exceeded a predetermined rotation speed from when the starter switch is turned on or from the start of the fuel injection.

10. A method of detecting a fuel property for an internal combustion engine wherein a parameter representing a starting performance of the engine, a parameter representing a change in engine rotation at the start of the engine, and a parameter representing a rising gradient of engine rotation speed at the start of the engine, are detected respectively, and a property of a fuel used is detected based upon the parameter representing the starting performance, the parameter representing a change in engine rotation and the parameter representing a rising gradient.

11. A method of detecting the fuel property for an internal combustion engine according to claim 10, wherein the fuel property is detected by weighting the parameter representing the starting performance, the parameter representing a change in engine rotation and the parameter representing a rising gradient.

12. A method of detecting the fuel property for an internal combustion engine according to claim 11, wherein the fuel property is detected based upon a comparison of an added value or a multiplied value of the parameter representing the starting performance, the parameter representing a change in engine rotation and the parameter representing a rising gradient that have been weighted, with a reference value determined depending on the engine temperature.

13. A method of detecting the fuel property for an internal combustion engine according to claim 12, wherein the parameter representing the starting performance, the parameter representing a change in engine rotation, the parameter representing a rising gradient and a reference value that is set depending upon the engine temperature are weighted and compared with each other, and the fuel property is detected based upon the comparison.

14. A method of detecting the fuel property for an internal combustion engine according to claim 10, wherein the parameter representing the starting performance, the parameter representing a change in engine rotation and the parameter representing a rising gradient, are detected based upon a period with a number of cycles of the engine as a unit.

15. A method of detecting the fuel property for an internal combustion engine according to claim 10, wherein a period of from when the starter switch is turned on or from the start of the fuel injection until when the engine rotation speed has reached a predetermined rotation speed, is detected as a parameter representing the starting performance.

16. A method of detecting the fuel property for an internal combustion engine according to claim 10, wherein the parameter representing a change in the rotation and the parameter representing a rising gradient of engine rotation speed are detected, respectively, after the engine rotation speed has reached a predetermined rotation speed from when the starter switch is turned on or from the start of the fuel injection.

17. A method for detecting the fuel property for an internal combustion engine according to claim 16, wherein a change amount of the engine rotation speed is operated for every predetermined unit period of time after the engine rotation speed has exceeded a predetermined rotation speed from when the starter switch is turned on or from the start of the fuel injection, and a period until an integrated value of the change amount has reached a predetermined value is detected as a parameter representing a change in engine rotation.

18. A method of detecting the fuel property for an internal combustion engine according to claim 16, wherein a period until an integrated value of a change amount of the engine rotation speed for every predetermined unit period of time reaches a second predetermined value from a first predetermined value is detected as a parameter representing a rising gradient after the engine rotation speed has exceeded a predetermined rotation speed from when the starter switch is turned on or from the start of the fuel injection.

* * * * *